US006003482A

United States Patent [19]

Kampichler

[11] Patent Number: 6,003,482

[45] Date of Patent: Dec. 21, 1999

[54] ROCKER ARM FOR AN INTERNAL COMBUSTION ENGINE

[75] Inventor: Gunter Kampichler, Ruhstorf, Germany

[73] Assignee: Motorenfabrik Hatz GmbH & Co. KG, Rushstorf, Germany

[21] Appl. No.: 09/051,346

[22] PCT Filed: Aug. 1, 1997

[86] PCT No.: PCT/EP97/04209

§ 371 Date: Apr. 6, 1998

§ 102(e) Date: Apr. 6, 1998

[87] PCT Pub. No.: WO98/05850

PCT Pub. Date: Feb. 12, 1998

[30] Foreign Application Priority Data

Aug. 5, 1996 [DE] Germany ..... 196 31 653

[51] Int. Cl.[6] ..... F01L 1/18

[52] U.S. Cl. ..... 123/90.41; 123/90.42

[58] Field of Search ..... 123/90.39, 90.41, 123/90.42, 90.5; 74/519, 559

[56] References Cited

U.S. PATENT DOCUMENTS

| | | | |
|---|---|---|---|
| 1,644,750 | 10/1927 | Short | 123/90.47 |
| 1,802,330 | 4/1931 | Boland | 123/90.5 |
| 4,829,647 | 5/1989 | Anderson et al. | 123/90.39 |
| 4,848,180 | 7/1989 | Mills | 123/90.39 |
| 5,273,005 | 12/1993 | Philo et al. | 123/90.5 |

FOREIGN PATENT DOCUMENTS

| | | |
|---|---|---|
| 614387 | 4/1926 | France . |
| 2819356 | 8/1979 | Germany . |
| 4024446 | 4/1991 | Germany . |
| 5-86817 | 4/1993 | Japan . |
| 5-179907 | 7/1993 | Japan . |

*Primary Examiner*—Weilun Lo
*Attorney, Agent, or Firm*—Helfgott & Karas, P.C.

[57] ABSTRACT

A rocker arm (1) for the valve control of an internal combustion engine, in which the rocker arm is manufactured from stamped, deep drawn and subsequently heat treated, deep drawing sheet metal and characterized by the fact that the rocker arm (1) has opposite side pieces, in between a rolling element (10) is acommodated in a rotation position.

6 Claims, 4 Drawing Sheets

ROCKER ARM FOR AN INTERNAL COMBUSTION ENGINE

FIELD OF THE INVENTION

The invention relates to a rocker arm for valve control of an internal combustion engine, where the valve lever is made from a punched, deep-drawn, and subsequently heat-treated deep-drawing metal sheet.

BACKGROUND OF THE INVENTION

Such rocker arms are known from the state of the art; they are generally used as transmission elements in three types of engine controls, for push-rod engines with the cam shaft on the bottom, for an overhead cam shaft with the rocker arm as the direct transmission element between the cam shaft and the valve, and with tappet control, where the rocker arm and the tappet form the transmission mechanism. In this connection, mechanical valve adjustment for sheet-metal rocker arms is performed at the ball socket bearing, or at the rocker arm end, by means of adjustment screws or eccentric elements. In this connection, the change in the lever ratio has a disadvantageous effect. Furthermore, the thumb rest on the valve-side end of the rocker arm, which is used in the state of the art, has disadvantageous friction values, resulting in high wear friction and wear of the valve guide, because of the lateral force of the valve shaft. In addition, in the case of the known, deep-drawn rocker arms, they must be additionally secured to prevent them from twisting, in order to stabilize the rocker arms around its longitudinal axis. Such a rocker arm is described in DE 4024446 A1. Here, the rocker arm is mounted on a roller bearing, to keep it from twisting.

The present invention is therefore based on the problem (task) of improving the known, deep-drawn rocker arm known from the state of the art, and significantly reducing the valve guide wear and, at the same time, simplifying production and making it more cost-effective.

This task is accomplished, according to the invention, by means of a rocker arm made from a punched, deep drawn and subsequently heat treated, deep drawn sheet metal, and a roller element is mounted in slits inside parts which are open in the direction of a valve shaft.

In accordance with the invention, the rocker arm is structured in such a way that it has opposite side parts, between which a roller element is held so as to rotate.

Because of the low rolling friction on the valve shaft, its lateral force on the valve guide is also reduced, and therefore the valve guide wear is significantly reduced. Furthermore, the rocker arm according to the invention can be produced very cost-effectively, since only deep-drawing and punching processes, but no cutting work, are required. Heat treatment of the deep-drawn part subsequently takes place by means of nitriding, carbonizing, or case-hardening. In the present case, valve adjustment takes place at the ball socket bearing, by means of a ball nut and a counter-bolt or counter-worm screw. Instead of the ball nut, a semi-cylindrical or cylindrical guide stone with a counter-nut can also be used. Furthermore, the invention provides that the roller element is mounted in slits in the side parts, which are open in the direction of the valve shaft. As a result, simple assembly is ensured, and additional locking of the roller element in the bearing is unnecessary, since the roller element is held in place in the bearing by the counter-pressure of the valve tappet.

Furthermore, it is advantageous that the roller element is loosely held in the slits. This ensures that it rotates easily, on the one hand, and that it is easy to assemble, on the other hand.

A highly advantageous embodiment of the invention provides that side guide parts are provided in the two end regions of the roller element, and that these extend beyond the valve shaft laterally. This prevents twisting of the rocker arm on the valve shaft, in surprisingly simple manner, i.e. the valve shaft is stabilized around its longitudinal axis. In this connection, the side guide parts can be connected in one piece with the roller element, i.e. project beyond its diameter, or can be separate components. It is important here that the rocker movement of the rocker arm and the rolling movement of the roller element are not hampered.

Furthermore, an advantageous embodiment of the present invention provides that the side guide parts are arranged between the side parts and the roller element. This fixes the rocker arm and the valve shaft in place, relative to one another, via the side guide parts.

Another advantageous embodiment provides that the side parts are guide disks. This makes it possible to use mass-produced parts, which are inexpensively available.

Finally, it is a highly advantageous embodiment of the present invention if the roller element has offset bearing ends. This reduces the number of components and makes assembly and storage costs more advantageous.

The present invention will be explained in greater detail below, on the basis of an exemplary embodiment, in connection with the attached figures. These show:

DETAILED DESCRIPTION

Figure 1:
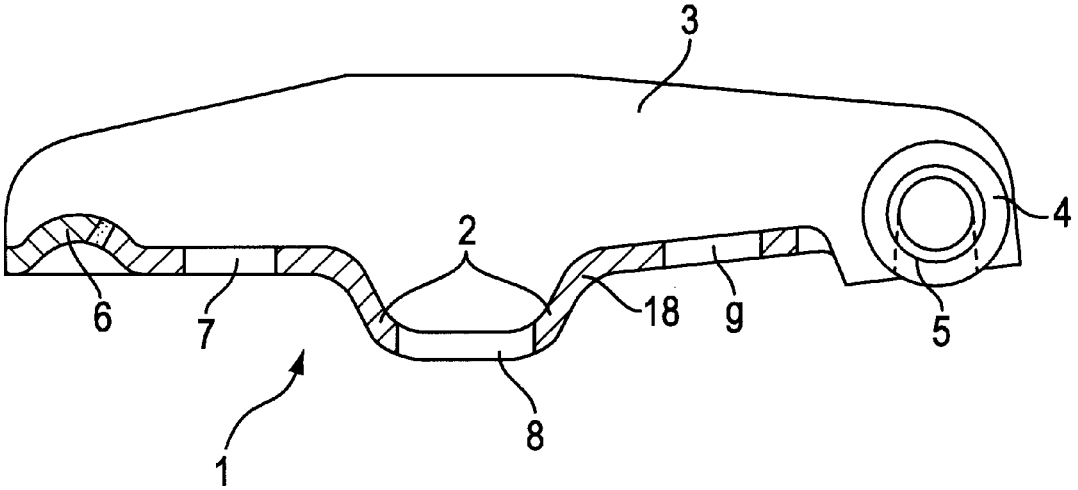
FIG. 1 a lengthwise cross-section through a toggle lever of the type according to the invention.

FIG. 1 shows a lengthwise cross-section through a rocker arm 1 with a spherical bearing bed 2, side part 3, band 18, guide disk 4, roller element bed 5, and tappet holder 6. Finally, the recesses 7, 8, and 9 are evident in the deep-drawing metal sheet.

In this connection, the rocker arm 1 consists of a deep-drawing metal sheet, the contours and recesses of which are punched out. Subsequently, the deep-drawing metal sheet is formed, with the two side parts 3 being bent perpendicular to the band 18, in order to reinforce the latter. The recess 8 serves to hold the ball nut and the bearing bolt, and the roller element bed 5 serves to hold the roller element and the guide disk 4. After forming, heat treatment takes place, in order to impart better strength characteristics and surface properties to the rocker arm.

Figure 2:
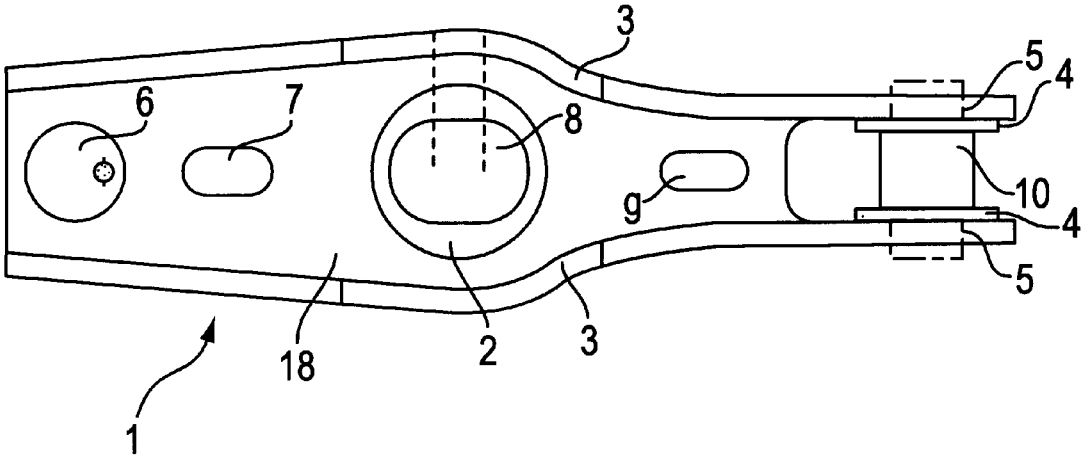
FIG. 2 a top view of a rocker arm according to FIG. 1.

FIG. 2 shows a top view of the rocker arm 1 of the type according to the invention, where the same parts are identified with the same reference numbers. In addition, FIG. 2 shows the roller element 10, which is arranged in the roller element bed 5, between the guide disks 4.

The rocker arm, which has been heat-treated by means of nitriding, carbonizing, or case-hardening, holds the roller element 10, which is mounted to rotate freely between the guide disks 4, in the roller element bed 5.

Figure 3:
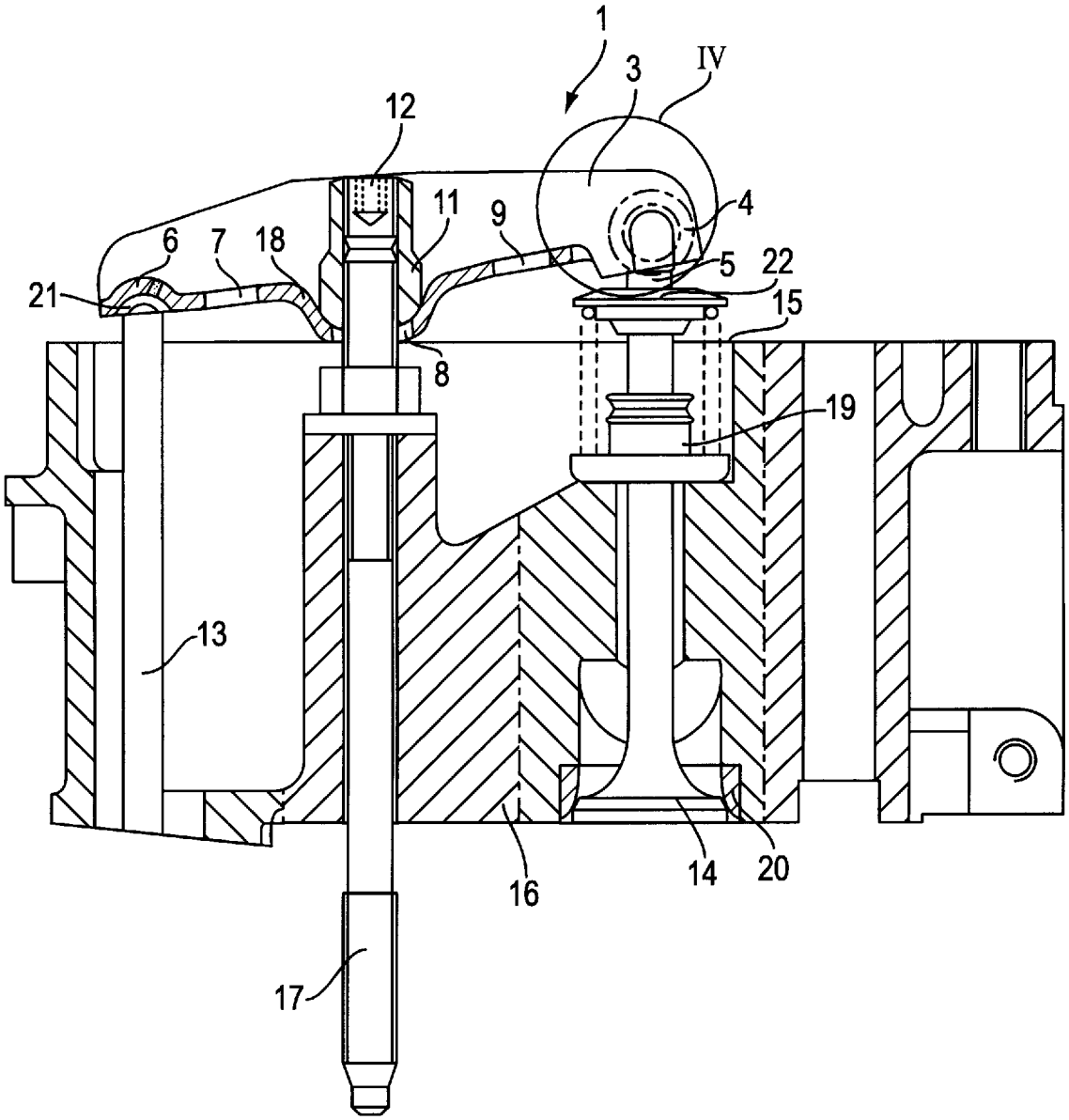
FIG. 3 a cross-section through a rocker arm of the type according to the invention in the installed state.

FIG. 3 shows a cross-section of the rocker arm according to FIG. 1 in the installed state. In addition to the parts already described in FIG. 1, the ball nut 11, a counter-bolt 12, a valve tappet 13, a valve 14, a valve spring 15, the housing 16, the bearing bolt 17, the valve guide 19, and the valve seat 20 can be seen.

The tappet 13 is driven by way of the cam shaft, not shown; the former is held in the tappet holder 6 with its end 21, which has a semi-spherical shape. By means of the up and down movement of the tappet 13, the rocker arm 1 is rocked around the ball nut 11, which is held in the spherical bearing bed 2. In this connection, the ball nut 11 is fixed in place on the bearing bolt 17. As a result of the toggle movement, the roller element, not shown, which is held in the roller element bed 5, presses on the valve shaft 22 of the valve 14. During the downward movement, the spring 15 is compressed, and the roller element rolls along the valve shaft 22. This causes the valve 14 to move out of the valve seat 20 and open. The upward movement of the rocker arm 1 is supported by the spring force of the spring 15. Furthermore, the roller element 10 is prevented from lifting off the valve tappet 13 in this way. Because the roller element, not shown, again rolls on the valve shaft, there are practically no friction losses during the up and down movement of the valve shaft.

Figure 4:
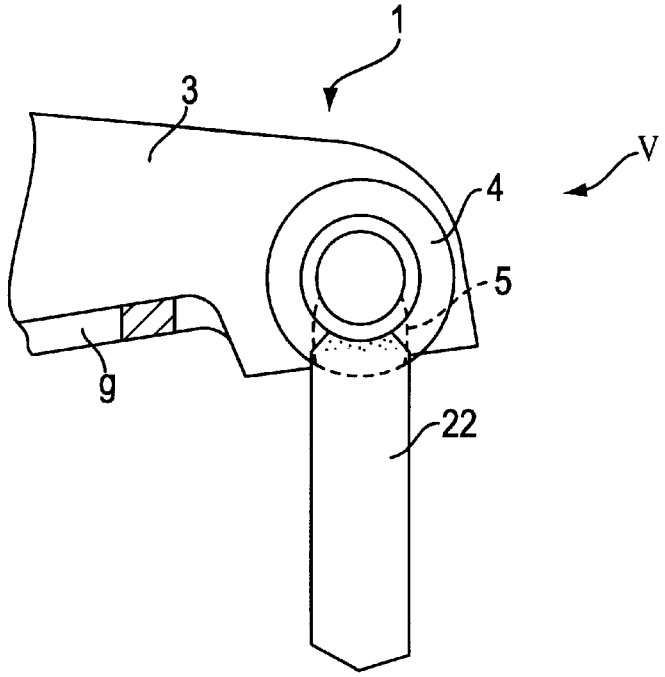
FIG. 4 detail IV from FIG. 3.

FIG. 4 shows detail IV from FIG. 3, where the guide function of the guide disk 4, which surrounds the valve shaft 22 on both sides, is clearly evident. This prevents twisting of the rocker arm 1, and the rocker arm is stabilized around its longitudinal axis.

Figure 5:
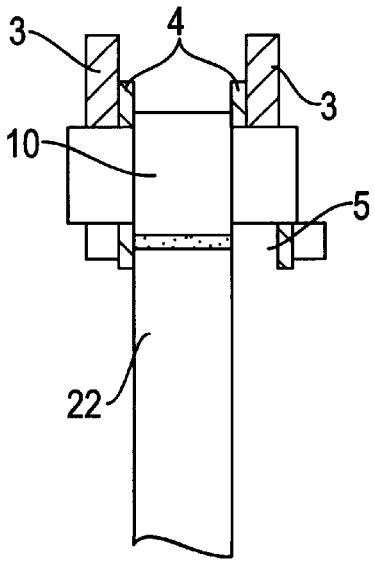
FIG. 5 a cross-section in the direction of the arrow V of the detail of FIG. 4.

FIG. 5 shows a cut-away view of the detail from FIG. 4 in the direction of the arrow V. Here the side walls 3 and the guide disks 4, as well as the roller element 10 and the valve shaft 22 are evident. The roller element 10 is mounted to rotate freely in the roller element bed 5, being fitted into the roller element bed 5 in such a way that only a very small amount of play remains, because of the guide disks 4. Because the valve shaft 22 is held laterally between the guide disks 4, and because of the support function which results from this, twisting of the rocker arm is effectively prevented.

Figure 6:
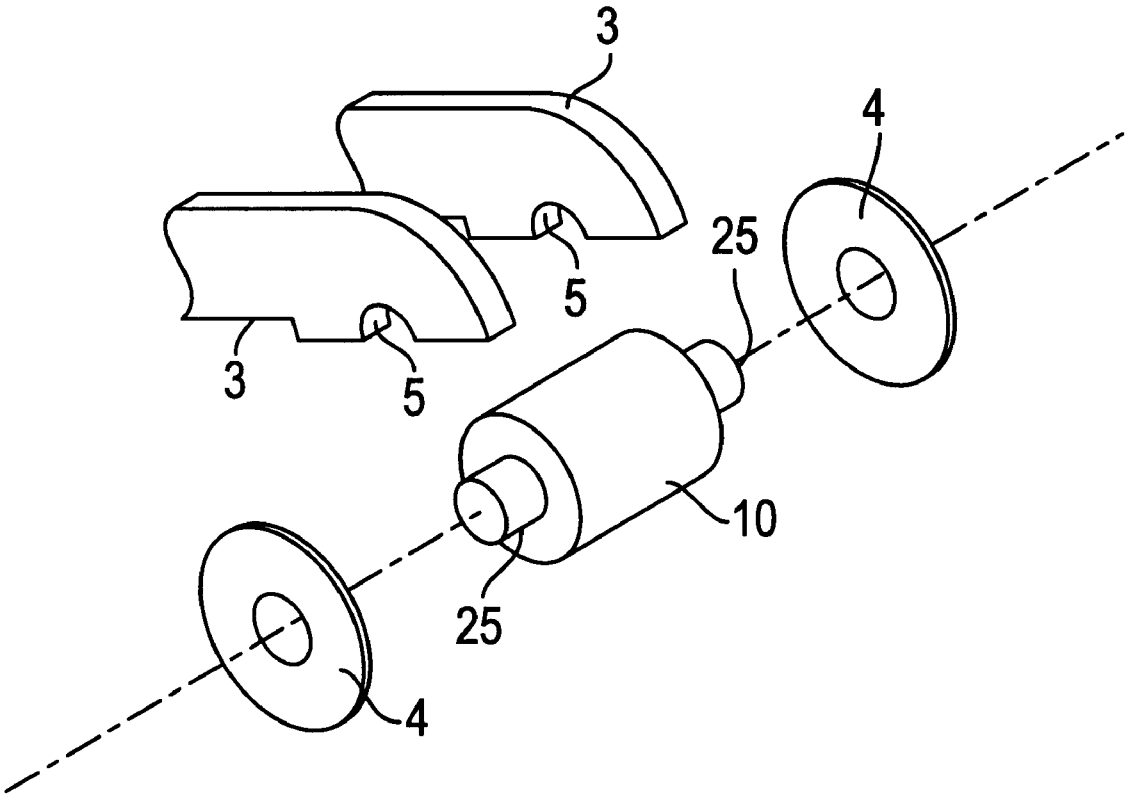
FIG. 6 a three-dimensional partial view of the individual parts of a rocker arm of the type according to the invention.

FIG. 6 shows an exploded view of a rocker arm of the type according to the invention, in which the side parts 3, the roller element bed 5, as well as the roller element 10 with offset bearing ends 25 and the guide disks 4 are shown.

During assembly, first the guide disks 4 are placed on the offset bearing ends of the cylindrical roller element 10. Subsequently, these parts are loosely inserted into the slit bearing 5 of the rocker arm 1. Because of the pressure on the valve tappet 13 resulting from the spring force of the spring 15, the roller element 10 is held in the roller element bed 5, together with the guide disks 4, preventing the roller element from lifting out of the bearing bed during operation.

I claim:

1. Rocker arm (1) for valve control of an internal combustion engine, where the rocker arm (1) has opposite side parts (3), between which a roller element is held so as to rotate, when pressed on an upper end of a valve shaft (22) of a valve (14), wherein the rocker arm (1) is made from a punched, deep-drawn and subsequently heat-treated deep-drawing sheet metal, and that the roller element (10) is mounted in slits (5) in the side parts (3), which are open in the direction of the valve shaft (22).

2. Rocker arm according to claim 1, wherein the roller element (10) is loosely held in the slits (5).

3. Rocker arm according to claim 1, wherein side guide parts are provided in the two end regions of the roller element (10), which extend beyond the valve shaft (22) laterally.

4. Rocker arm according to claim 3, wherein the side guide parts are arranged between the side parts (3) and the roller element (10).

5. Rocker arm according to claim 4, wherein the side guide parts are guide disks (4).

6. Rocker arm according to claim 1, wherein the roller element (10) is provided with bearing ends with reduced diameters.

* * * * *